United States Patent [19]

Warner

[11] Patent Number: 4,678,367

[45] Date of Patent: Jul. 7, 1987

[54] RISER ASSEMBLY FOR A SUB-SURFACE IRRIGATION AND DRAINAGE SYSTEM

[76] Inventor: James I. Warner, R.R. 2, Box 106, Fairfield, Iowa 52556

[21] Appl. No.: 823,725

[22] Filed: Jan. 29, 1986

[51] Int. Cl.[4] ..... E02B 11/00; E02B 13/00

[52] U.S. Cl. ..... 405/39; 251/145; 405/41; 405/104

[58] Field of Search ..... 405/39, 40, 41, 43, 405/45, 104, 105, 36, 37; 251/145, 146

[56] References Cited

U.S. PATENT DOCUMENTS

| | | | |
|---|---|---|---|
| 325,552 | 9/1885 | Mallard | 405/104 |
| 572,842 | 12/1896 | Towne | 405/41 |
| 778,323 | 12/1904 | Martin | 405/41 |
| 796,590 | 8/1905 | Martin . | |
| 806,901 | 12/1905 | Mendenhall | 405/41 |
| 947,325 | 1/1910 | Callaway | 405/104 X |
| 970,383 | 9/1910 | McCulloch . | |
| 988,639 | 4/1911 | Johnston . | |
| 1,173,534 | 2/1916 | Ryan | 405/39 X |
| 2,362,747 | 11/1944 | Duke . | |
| 2,820,479 | 1/1958 | Jenkins | 405/39 X |
| 3,159,172 | 12/1964 | Baxter | 251/145 X |
| 3,572,630 | 3/1971 | Mendenhall | 251/145 |
| 4,180,348 | 12/1979 | Taylor | 405/39 |
| 4,621,945 | 11/1986 | Schafer et al. | 405/39 |

OTHER PUBLICATIONS

Brochure-Advanced Drainage Systems, Inc. (ADS) No. L-2003, Copyright 1984.

Brochure-"SIDS Subsurface Irrigation and Drainage System" from Hancor, Inc.

"Fine Tuning and Irri-Drain System", pp. 6, 7 & 18 of the Jul. 1983, issue of Land & Water.

"Days Make Vast Contributions to the Development of Irrigation-Drainage Systems", pp. 32-34 of the Feb./-Mar. 1984 Issue of Land & Water.

*Primary Examiner*—Dennis L. Taylor

*Attorney, Agent, or Firm*—Bacon & Thomas

[57] ABSTRACT

A riser assembly for a sub-surface irrigation and drainage system is disclosed having a molded, housing defining a generally rectangular, elongated cavity. A divider within the housing divides the cavity into an upstream chamber and a downstream chamber. A drainage opening and a weir opening are defined by the divider, and slidable gate valves are disposed over each opening. By adjusting the positions of the gate valves, the upstream water level cable may be readily adjusted.

19 Claims, 8 Drawing Figures

Fig. 1
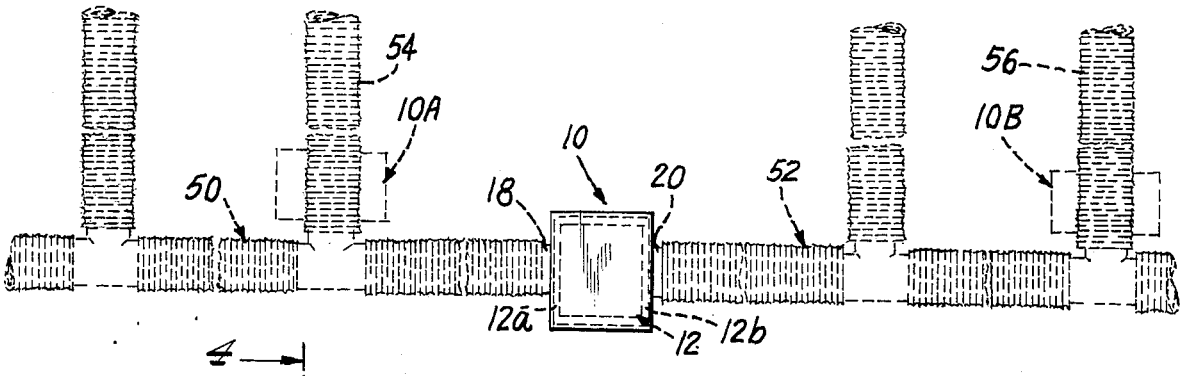
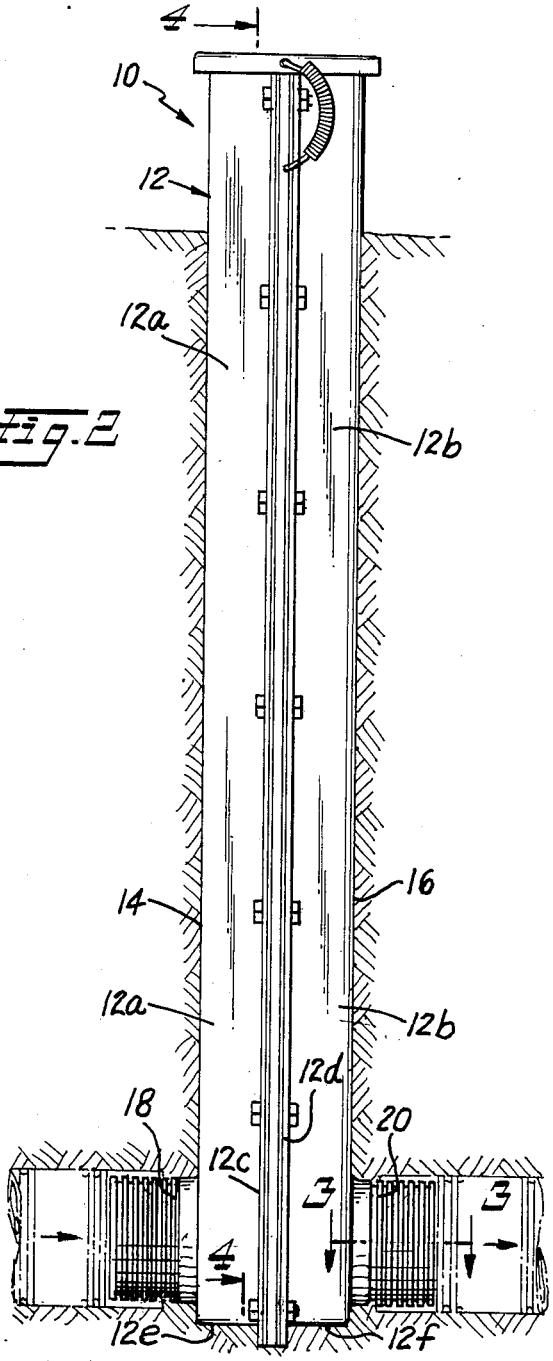
Fig. 2
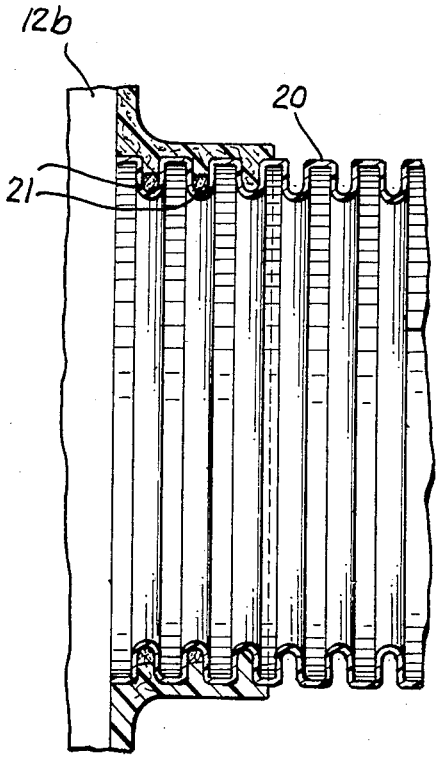
Fig. 3

RISER ASSEMBLY FOR A SUB-SURFACE IRRIGATION AND DRAINAGE SYSTEM

FIELD OF THE INVENTION

The instant invention relates to a riser assembly for a sub-surface irrigation and drainage system, particularly such a riser having a divider with slidable gate valves which control the drainage opening and the weir opening.

BRIEF DESCRIPTION OF THE PRIOR ART

Sub-surface irrigation and drainage systems are well known in the art and typically comprise a network of porous tile lines disposed at a predetermined depth below the soil surface. When the system is operated as a drainage system, the excess subterranean water enters the line through the porous tiles and is directed toward a drainage area. When such a system is to be utilized for sub-surface irrigation, means are provided in the tile line to block off the flow to the drainage area, thereby causing the water to backup in the pipe and flow back into the soil. By controlling the water flow, a predetermined water table height may be maintained to properly irrigate the crops planted in the ground above.

While such irrigation and drainage systems have proven to be generally effective, the riser structures necessary to control the water flow and the water head pressure have proven to be difficult and costly to install and, in many cases, do not provide the degree of control necessary to accurately achieve the predetermined water table level. In many cases, it is necessary to excavate a relatively large hole in the ground to install a concrete or metal riser structure. Once the excavation has been backfilled to cover the major portion of the riser, the metallic risers are, of course, subject to corrosion and other damage.

The riser systems according to the prior art have typically utilized flap valves to control the water flow, which, as is often the case, can only be movable between a fully open and a fully closed position.

It is also known to provide an overflow system within the riser to maintain the water head pressure at a predetermined level. Typically, this overflow control has taken the form of a pipe inserted through the riser and leading to the drainage area such that, when the water reaches the level of the pipe opening, any additional water will pass on to the drainage area. This system suffers from the drawback of being non-adjustable and it is impossible to adjust or control the level of the water table without major reconstruction of the riser assembly.

Adjustable overflow devices are also known in which a vertical pipe, located in the riser and connected to the drainage pipe, has a plurality of openings formed at discrete intervals along its sidewall. A slidable sleeve is adjustable over the exterior of the pipeline to close off selected ones of the openings and to thereby control the level of the water within the riser assembly. This system suffers from the drawbacks of being only adjustable in discrete levels, not providing a completely water-tight seal, and does not provide an infinitely variable adjustment of the water level within the riser assembly.

Since the control valve mechanisms are typically located at the lower portion of the riser assemblies, the prior art devices have necessitated forming the risers sufficiently large to enable maintenance of the valve structures to be performed by one or more service personnel. The increase in size necessary to accommodate the servicing necessarily increases the costs of both manufacturing and installing the riser assembly.

SUMMARY OF THE INVENTION

The present invention obviates the difficulties of the prior art systems by providing a riser assembly having a housing defining a generally rectangular, hollow elongated upwardly opening cavity, the housing having a pair of tile sections mechanically interlocked with the material forming the housing so that each tile section is permanently attached to the housing. The housing may be formed of a molded fiberglass material, while the tile sections are formed of a polyethylene material. Since fiberglass would not ordinarily bond to the polyethylene tile sections, the fiberglass material forming the housing is molded into a plurality of the external corrugations of the tile sections such that, when the fiberglss material has cured, the tile sections are mechanically, and permanently interlocked with the housing. Other types of tiles, such as PVC, metal, corrugated metal, etc., can also be used with the riser assembly.

Disposed within the housing is a divider extending generally parallel to the sides of the housing and dividing the elongated cavity into an upstream chamber communicating with the upstream tile section and a downstream chamber communicating with the downstream tile section. The divider defines the lower drainage opening and an upper weir opening which extend through the divider. Slidable gate valves are slidably and removably attached to the divider such that one of the gate valves serves to open and close the drainage opening, while the second gate valve adjusts the height of the weir opening. Means are provided to adjust the vertical position of each of the gates externally of the riser housing. This not only facilitates the precise adjustment of each of the gate valves, but enables each of them to be removed from the divider without the necessity of removing the entire riser assembly, or making it large enough to accommodate service personnel. All servicing of the gate valves, such as cleaning, changing gaskets, etc. can be accomplished easily from the exterior of the riser assembly.

The divider as well as the gate valves may also be fabricated from a polyethylene material. The housing itself may be formed by a pair of mirror image halves of molded fiberglass material attached to either side of the divider assembly. The attaching means may be stainless steel bolts or the like, such that the entire structure is made of corrosion resistant materials.

BRIEF DESCRIPTION OF THE DRAWINGS

FIG. 1 is a partial plan view of an irrigation system incorporating the riser assembly according to the invention.

FIG. 2 is an elevational view of the riser assembly shown in FIG. 1.

FIG. 3 is an enlarged, partial sectional view showing the connection between a side of the riser assembly and the associated tile.

DETAILED DESCRIPTION OF THE PREFERRED EMBODIMENTS

Figure 4:
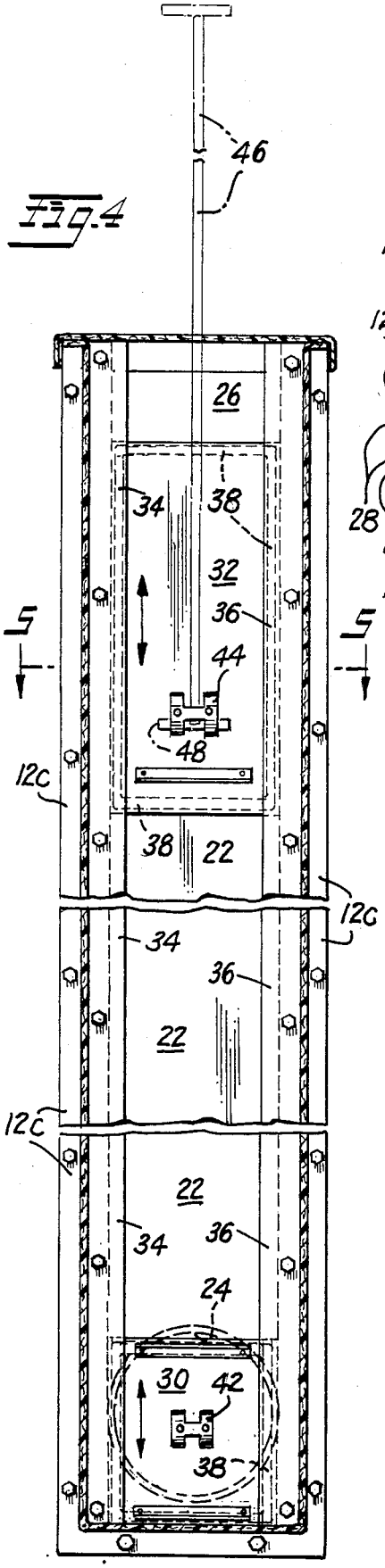
FIG. 4 is a sectional view of the riser assembly taken along line 4—4 in FIG. 2.
Figure 5:
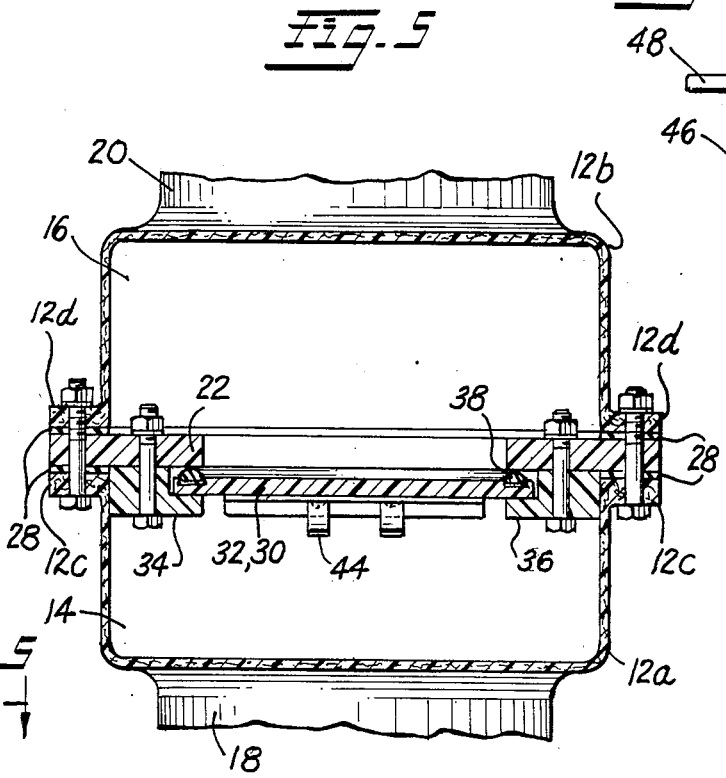
FIG. 5 is a sectional view of the riser assembly taken along line 5—5 in FIG. 4.
Figure 6:
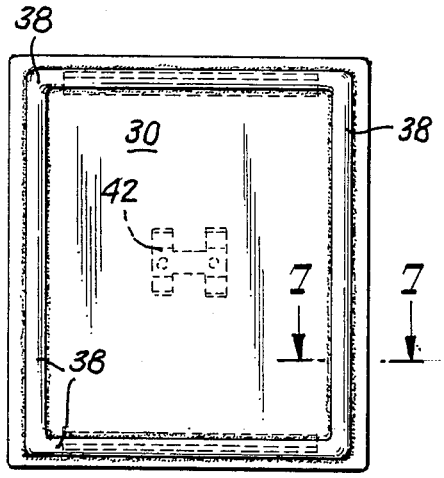
FIG. 6 is an elevational view of the lower gate valve utilized in the riser assembly according to the invention.
Figure 7:
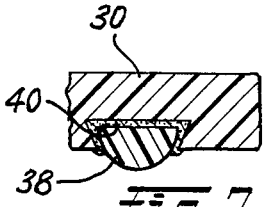
FIG. 7 is an enlarged, partial sectional view taken along line 7—7 in FIG. 6.
Figure 8:
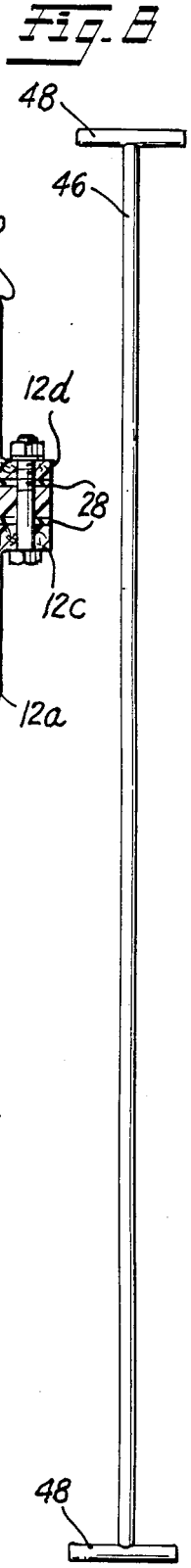
FIG. 8 is an elevational view of a valve adjusting handle utilized with the riser assembly according to the invention.

The riser assembly according to the invention is indicated generally at 10 and comprises a housing 12 having a generally rectangular cross-sectional configuration with upstream side 14 and downstream side 16. Housing 12 may comprise first section 12*a* and second section 12*b*, each having a generally "U" shaped cross section and formed of a molded fiberglass material. Each of the sections 12*a* and 12*b* has a laterally protruding flange 12*c* and 12*d* extending about two opposite sides and across the bottom. Integral bottom portions 12*e* and 12*f* may also be molded integrally with the first and second sections 12*a* and 12*b*. The molded fiberglass of the sides of the housing may be approximately ⅛" thick, while the thickness of flanges 12*c* and 12*d* may be approximately ¼" thick. Obviously, these dimensions may vary according to the size and the usage conditions to which the riser housing is to be subjected. Corrugated upstream tile section 18 and corrugated downstream tile section 20 are permanently attached to housing sections 12*a* and 12*b*, respectively. The tile sections are typically fabricated from a polyethylene material which does not ordinarily bond with the molded fiberglass material of the housing sections. A mechanical interlock of the tile sections with the housing sections is achieved by molding the housing sections such that the fiberglass material engages a plurality of the external corrugations of each of the tile sections as shown in FIG. 3. It has been found that by molding the fiberglass such that it engages a plurality of the external corrugations of the tile section, a permanent, mechanically interlocked connection can be effected. A sealant material 21 may be placed in the corrugations to insure that the connection between the tile sections and the housing sections is watertight.

Divider 22 is mounted within the housing 12 and extends generally parallel to the upstream side 14 and the downstream side 16. The divider defines a lower drainage opening 24 and an upper weir opening 26. The divider 22 may be attached between flanges 12*c* and 12*d* of the respective housing sections by bolts, or other fastening means. The bolts or other fastening means should be formed of stainless steel or other corrosion resistant materials, since the bulk of the riser assembly will be buried underneath the ground. A gasket 28 is provided on either side of the divider 22 between the divider and the housing section flange to insure that no water leakage occurs between the joint. The gasket may be formed of any material which will effect a watertight seal, such as rubber or a sponge rubber.

A first gate valve 30 is slidably attached to the divider adjacent the lower drainage opening, and a second gate valve 32 is slidably attached to the divider by retaining members 34 and 36, respectively. Retaining members 34 and 36 are rigidly attached to the divider 22 by any known fastening means and define a channel therebetween which allows the gate valves 30 and 32 to slide with respect to the divider.

A watertight seal between the gate valves and the divider is maintained by a gasket attached to each of the gate valves on the surface facing the divider. The resilient gasket 38 may be snap-fit into a dovetail groove 40 formed in first gate 30, as shown. A glue or other adhesive material may be placed in the dovetail groove to retain the gasket to the gate valve. A similar gasket and groove assembly may be utilized in the second gate valve 32 to prevent water leakage between the divider and the gate valves.

The spacing between the retaining members 34 and 36, and the divider 22 should be such that the gate valves 30 and 32 may slide, but should be sufficiently tight to frictionally retain them in any adjusted position and to maintain a proper gasket seal against the divider surface.

Brackets 42 and 44 may be attached to the first gate valve 30 and the second gate valve 32, respectively, to allow their respective positions to be adjusted from the upper opening of the housing 12. In plan view, each of the brackets 42, 44 have a generally "H" shaped configuration with the distal ends extending outwardly from the surface of the gate valve. The outwardly extending ends may be engaged by a handle 46 having a lower cross member 48. The length of the handle should be sufficient to enable the operator to reach down into the riser assembly so as to adjust the position of the first, lower gate valve 30.

As can be seen from the figures, the lateral dimensions of the riser assembly 10 is kept to a minimum which permits its installation into the tile trench without the necessity of additional excavation. Since the riser is formed of relatively light weight and corrosion resistant materials, it may be readily installed and, once installed, provide a trouble free operation. The tile sections 18 and 20 attached to the riser assembly may be readily connected to existing tile lines by known coupling means.

In operation, when the soil conditions are such that no additional irrigation is required, the gate valves 32 and 30 are raised such that gate valve 30 opens the drainage opening 24 in divider 22. This allows water to pass through the soil, into the tile line 50 and through the riser assembly to the drainage line 52 without impeding its flow. Should the conditions necessitate subsurface irrigation of the crops, gate valve 30 is lowered so as to close the drainage opening 24. This requires water entering the upstream chamber through upstream tile section 18 to pass over the top of the second gate valve 32 before passing into the downstream chamber and to the drainage area through tile section 20. By adjusting the height of the second gate valve 32, the waterhead pressure existing in the upstream tile line 50 may be accurately controlled. By adjusting this pressure, the water table beneath the irrigated area may be readily controlled. The second gate valve 32 may be located at any adjustment, thereby insuring an accurate head pressure control.

Although the riser 10 is shown only in the main irrigation/drainage line 50, 52 in FIG. 1, it is to be understood that risers could be placed in upstream lines 54, as at 10A, and/or in downstream lines 56, as at 10B. In each case, the structure and operation of the riser assembly would be identical to that previously described.

The foregoing descriptions are provided for illustrative purposes only and should not be construed as in any way limiting this invention, the scope of which is defined solely by the appended claims.

What is claimed is:

1. A riser assembly for a sub-surface irrigation and drainage system having at least one underground tile pipeline, the riser assembly comprising:

(a) a housing defining a hollow, elongated, upwardly opening cavity, the housing having an upstream side and downstream side;
(b) an upstream tile section mechanically interlocked with the material forming the upstream side of the housing so as to be permanently attached thereto;
(c) a downstream tile section mechanically interlocked with the material forming the downstream side of the housing so as to be permanently attached thereto;
(d) a divider mounted within the housing and extending generally parallel to the upstream and downstream sides so as to divide the elongated cavity into an upstream chamber communicating with the upstream tile section and a downstream chamber communicating with the downstream tile section, the divider defining a lower drainage opening and an upper weir opening;
(e) a first gate valve slidably attached to the divider adjacent the lower drainage opening such that, as the gate valve is raised or lowered the drainage opening is opened or closed, respectively; and,
(f) a second gate valve slidably attached to the divider adjacent to the upper weir opening to adjust the height to which the water must rise to pass from the upstream chamber to the downstream chamber when the drainage opening is closed.

2. The riser assembly according to claim 1 wherein the upstream tile section has a corrugated exterior surface and the material forming the upstream side engages a plurality of the corrugations so as to permanently, mechanically interlock the tile to the side.

3. The riser assembly according to claim 2 wherein the material forming the upstream side of the riser engages at least two corrugations on the upstream tile.

4. The riser assembly according to claim 2 wherein the downstream tile section has a corrugated exterior surface and the material forming the downstream side engages a plurality of the corrugations so as to permanently mechanically interlock the tile to the side.

5. The riser assembly according to claim 4 wherein the material forming the downstream side of the riser engages at least two corrugations on the downstream tile.

6. The riser assembly according to claim 4 further comprising gasket means attached to the first gate valve and slidably contacting the divider so as to prevent leakage of water between the first gate valve and the divider.

7. The riser assembly according to claim 6 wherein the first gate valve defines a groove having a dovetail shaped cross-section and the gasket means is retained in the groove.

8. The riser assembly according to claim 6 further comprising second gasket means attached to the second gate valve and slidably contacting the divider so as to prevent water leakage between the second gate valve and the divider.

9. The riser assembly according to claim 4 further comprising means to adjust the positions of the first and second gate valves.

10. The riser assembly according to claim 9 wherein the adjustment means comprises:
(a) a first bracket attached to the first gate valve;
(b) a second bracket attached to the second gate valve; and,
(c) handle means engageable with the first or second brackets.

11. The riser assembly according to claim 9 further comprising a cover so as to cover the upwardly opening cavity.

12. The riser assembly according to claim 11 further comprising attaching means to attach the cover to an upper portion of the housing.

13. The riser assembly according to claim 9 wherein the housing comprises:
(a) a first section having the upstream side, the first section having a generally "U" shaped cross-section;
(b) a second section having the downstream side, the second section having a generally "U" shaped cross-section; and,
(c) fastening means to fasten the first section, the divider and the second section together.

14. The riser assembly according to claim 13 wherein each section has a bottom portion integrally formed therewith to define a bottom of the housing when the sections are assembled with the divider.

15. The riser assembly according to claim 14 wherein the first and second sections are formed of a molded fiberglass material.

16. The riser assembly according to claim 15 wherein the divider is formed of a polyethylene material.

17. The riser assembly according to claim 16 further comprising resilient gasket means attached between the fiberglass first and second sections, and the polyethylene divider.

18. The riser assembly according to claim 17 wherein the first and second gate valves are formed of polyethylene material.

19. A riser assembly for a sub-surface irrigation and drainage system having at least one underground tile pipeline, the riser assembly comprising:
(a) a housing defining a hollow, elongated upwardly opening cavity, the housing having an upstream side and a downstream side and comprising:
(i) a first section of fiberglass material having the upstream side, a generally "U" shaped cross-section, and a bottom portion formed integrally therewith; and,
(ii) a second section of fiberglass material having the downstream side, a generally "U" shaped cross-section and bottom portion formed integrally therewith;
(b) an upstream polyethylene tile section having a corrugated exterior surface and permanently attached to the upstream side of the housing by the material forming the upstream side engaging and mechanically interlocking with a plurality of the corrugations;
(c) a downstream polyethylene tile section having a corrugated exterior surface and permanently attached to the downstream side of the housing by the material forming the downstream side engaging and mechanically interlocking with a plurality of the corrugations;
(d) a divider of polyethylene material located between the first and second sections of the housing and extending generally parallel to the upstream and downstream sides so as to divide the elongated cavity into an upstream chamber communicating with the upstream tile section and a downstream chamber communicating with the downstream tile section, the divider defining a lower drainage opening and an upper weir opening;

(e) fastening means to fasten the first section, the divider and the second section together;

(f) a first gate valve of polyethylene material slidably attached to the divider adjacent the lower drainage opening such that, as the first gate valve is raised or lowered, the open area of the drainage opening is varied;

(g) a second gate valve of polyethylene material slidably attached to the divider adjacent to the upper weir opening to adjust the height to which the water must rise to flow through the weir opening and pass from the upstream chamber to the downstream chamber when the drainage opening is closed; and, (h) means to adjust the positions of the first and second gate valves comprising:

(i) a first bracket attached to the first gate valve;

(ii) a second bracket attached to the second gate valve; and, (iii) handle means engageable with the first or second brackets.

* * * * *